US007722710B2

(12) United States Patent
Inbe et al.

(10) Patent No.: US 7,722,710 B2
(45) **Date of Patent: *May 25, 2010**

(54) SURFACE-CONDITIONING COMPOSITION, METHOD FOR PRODUCTION THEREOF, AND SURFACE CONDITIONING METHOD

(76) Inventors: Toshio Inbe, c/o Nippon Paint Co., Ltd., 4-1-15, Minamishinagawa, Shinagawa-ku, Tokyo 140-8675 (JP); Masahiko Matsukawa, c/o Nippon Paint Co., Ltd., 4-1-15, Minamishinagawa, Shinagawa-ku, Tokyo 140-8675 (JP); Kotaro Kikuchi, c/o Nippon Paint Co., Ltd., 4-1-15, Minamishinagawa, Shinagawa-ku, Tokyo 140-8675 (JP)

( * ) Notice: Subject to any disclaimer, the term of this patent is extended or adjusted under 35 U.S.C. 154(b) by 126 days.

This patent is subject to a terminal disclaimer.

(21) Appl. No.: 11/990,564

(22) PCT Filed: Aug. 21, 2006

(86) PCT No.: PCT/JP2006/316343

§ 371 (c)(1),
(2), (4) Date: Feb. 14, 2008

(87) PCT Pub. No.: WO2007/021024

PCT Pub. Date: Feb. 22, 2007

(65) Prior Publication Data

US 2009/0223407 A1 Sep. 10, 2009

(30) Foreign Application Priority Data

Aug. 19, 2005 (JP) ..... 2005-239233

(51) Int. Cl.
*C23C 22/78* (2006.01)

(52) U.S. Cl. ..... 106/14.41; 106/14.05; 106/14.12; 106/14.44; 148/243; 148/248; 148/251; 148/254

(58) Field of Classification Search ..... 106/14.05, 106/14.12, 14.41, 14.44; 148/243, 248, 251, 148/254

See application file for complete search history.

(56) References Cited

U.S. PATENT DOCUMENTS

| | | | | |
|---|---|---|---|---|
| 2004/0011429 | A1 * | 1/2004 | Miyamoto et al. | 148/254 |
| 2005/0184276 | A1 * | 8/2005 | Nakazawa | 252/387 |
| 2005/0187326 | A1 * | 8/2005 | Nakazawa | 524/417 |

FOREIGN PATENT DOCUMENTS

| | | |
|---|---|---|
| JP | 59-226181 | 12/1984 |
| JP | 10-245685 | 9/1998 |
| JP | 2000-096256 | 4/2000 |
| JP | 2004-068149 | 3/2004 |
| SU | 1410504 A1 * | 8/1996 |

* cited by examiner

*Primary Examiner*—Anthony J Green
(74) *Attorney, Agent, or Firm*—Dilworth & Barrese LLP

(57) ABSTRACT

A surface-conditioning composition can form a denser phosphate coating film having more satisfactory coating weight on the surface of a metal material compared to a conventional one and, therefore, can reduce the electrolytic corrosion of a metal material during a chemical conversion treatment, form a chemical conversion coating film having a satisfactory coating weight even when applied to a hardly convertible metal material (e.g., an aluminum metal material, a high tensile strength steel plate), improve the productivity rate of the chemical conversion treatment, resulting in the reduction of the time required for the chemical conversion treatment, and enables a metal phosphate particle to be dispersed in a surface-conditioning solution highly stably. This composition includes a particle of a phosphate of a bivalent or trivalent metal and has a pH value ranging from 3 to 12. The particle has a $D_{50}$ value of 3 μm or less. The composition additionally includes (1) a phenolic compound and (2) a stabilizing agent.

6 Claims, 1 Drawing Sheet

SURFACE-CONDITIONING COMPOSITION, METHOD FOR PRODUCTION THEREOF, AND SURFACE CONDITIONING METHOD

TECHNICAL FIELD

The present invention relates to a surface conditioning composition, and a surface conditioning method.

BACKGROUND ART

Automotive bodies, home electrical appliances and the like have been manufactured in which metal materials such as steel sheets, galvanized steel sheets, and aluminum-based metal materials are made into a molded metal form, and thereafter painting, assembly and the like are performed. The painting of such a molded metal form is performed through various processes such as degreasing, surface conditioning, chemical conversion treatment, and electrodeposition coating.

Generally, in surface conditioning, phosphate nuclei are formed on the surface of a metal material by dipping into a treatment liquid for surface conditioning. The surface conditioning is performed for the sake of the subsequent phosphate chemical conversion treatment, in which a chemical conversion coating film made of phosphate crystals is formed on the entire surface of the metal material uniformly, quickly and with high density. As a treatment liquid used for such a surface conditioning treatment, a composition is known in which bivalent or trivalent metal phosphate is combined with various stabilizers (e.g., Patent Document 1, Patent Document 2 and Patent Document 3).

Patent Document 1 discloses a pretreatment liquid for surface conditioning used before the phosphate chemical conversion treatment of a metal, which has a pH adjusted to be 4 to 13, and which includes: at least one selected from phosphate particles including at least one kind of bivalent or trivalent metals including a particle of a diameter of no more than 5 μm; an alkali metal salt, an ammonium salt or a mixture thereof; and at least one selected from the group consisting of an anionicly charged and dispersed oxidant fine particle, anionic water-soluble organic polymer, nonionic water-soluble organic polymer, anionic surfactant, and nonionic surfactant.

Patent Document 2 discloses a treatment liquid for surface conditioning before phosphate chemical conversion treatment, which contains at least one kind of phosphate particle selected from phosphate containing at least one of bivalent and/or trivalent metals, and which further contains (1) at least one kind selected from monosaccharide, polysaccharide and a derivative thereof; (2) orthophosphoric acid, polyphosphoric acid or an organic phosphon acid compound, and at least one kind of water-soluble polymer compound consisting of a polymer or a derivative of vinyl acetate, or a copolymer of monomer, which is copolymerizable with vinyl acetate, and vinyl acetate; or (3) a polymer or copolymer resulting from polymerization of: at least one kind selected from a particular monomer or a, β unsaturated carboxylic acid monomer; and no more than 50 mass % of a monomer which is copolymerizable with the monomer. Moreover, Patent Document 3 discloses a surface conditioning composition in which clay mineral is used together with phosphate.

However, even the treatment liquids for surface conditioning disclosed in these documents may not have sufficient chemical conversion properties. For example, in the portion where aluminum-based metal materials come in contact with steel sheets or galvanized steel sheets, the aluminum-based metal materials become an anode, and the steel sheets or galvanized steel sheets become a cathode, and therefore electrochemical corrosion reactions (electrolytic corrosion) tend to occur due to the potential difference of the different kinds of metal. This leads to a problem in that it is difficult to form a chemical conversion coating film on the surface of the aluminum-based metal materials at the time of the chemical conversion treatment. Due to this, a surface conditioning composition, which can suppress electrolytic corrosion of the aluminum-based metal materials in a chemical conversion treatment, is intended to be developed.

In addition, when these treatment liquids for surface conditioning are applied to conversion resistant metal materials such as aluminum-based metal materials and high-tensile steel sheets, there is a problem in that a sufficient amount of chemical conversion coating film is not formed on the surface of the metal materials in a chemical conversion treatment. In addition, the required level of corrosion resistance has been increased in recent years, and the formation of a more dense chemical conversion coating film has been desired. Moreover, regarding these treatment liquids for surface conditioning, the particle size of the phosphate particles is large, and the dispersion stability of particles in the treatment bath is insufficient, and there is a problem that phosphate particles tend to precipitate. Due to this, a surface conditioning composition which solves these problems and which has further superior properties has been desired.

Patent Document 1: Japanese Unexamined Patent Application, First Publication No. H10-245685

Patent Document 2: Japanese Unexamined Patent Application, First Publication No. 2000-96256

Patent Document 3: Japanese Unexamined Patent Application, First Publication No. S59-226181

DISCLOSURE OF THE INVENTION

Problems to be Solved by the Invention

In view of the aforementioned problems, an object of the present invention is to provide a surface conditioning composition to be used for surface conditioning performed before a chemical conversion treatment. In the chemical conversion treatment reaction, the surface conditioning composition can result in higher chemical conversion performance as compared to that conventionally, can form a dense metal chemical conversion coating film, can suppress electrolytic corrosion of the aluminum-based metal materials during the chemical conversion treatment, can form a sufficient amount of chemical conversion coating film even when the chemical conversion treatment is performed on conversion resistant metal materials such as aluminum-based metal materials and high-tensile steel sheets, can shorten the time required for the chemical conversion treatment by improving the chemical conversion properties, and has excellent long-term dispersion stability during the treatment bath.

Means for Solving the Problems

The surface conditioning composition of the present invention includes bivalent or trivalent metal phosphate particles, and has a pH of 3 to 12, which is characterized by the $D_{50}$ of the bivalent or trivalent metal phosphate particles being no more than 3 μm, and containing (1) a phenolic compound and (2) a stabilizer.

The aforementioned bivalent or trivalent metal phosphate particle is preferably zinc phosphate.

The aforementioned (1) phenolic compound is preferably at least one selected from the group consisting of flavonoid, tannin, gallic acid, lignin, catechin, and pyrogallol. In cases where the surface conditioning composition of the present invention is the treatment liquid for surface conditioning, it is preferred that a concentration of 1 to 1000 ppm of the aforementioned (1) phenolic compound is contained therein. The aforementioned (2) stabilizer is preferably at least one selected from the group consisting of phosphonic acid, phytic acid, polyphosphoric acid, phosphonic acid group-containing acrylic resin and vinylic resin, carboxyl group-containing acrylic resin and vinylic resin, saccharide, and layered clay mineral. In cases where the composition for surface conditioning of the present invention is the treatment liquid for surface conditioning, it is preferred that a concentration of 1 to 1000 ppm of the aforementioned (2) stabilizer be contained therein.

In the present invention, a method for surface conditioning includes a step of bringing the aforementioned treatment liquid for surface conditioning that is a composition for surface conditioning in contact with a metal material surface.

The term "surface conditioning composition" referred to herein indicates to include both a "treatment liquid for surface conditioning" that is a treatment liquid for bringing into contact with the metal material actually in the surface conditioning treatment, and a "concentrated dispersion liquid" that is a dispersion liquid of the metal phosphate particles used for producing the treatment liquid for surface conditioning through dilution. The treatment liquid for surface conditioning is obtained by diluting the concentrated dispersion liquid with a solvent such as water to give a predetermined concentration, and adding the necessary additives followed by adjusting the pH.

Furthermore, in cases where the surface conditioning composition of the present invention is used, the surface conditioning treatment is carried out after subjecting the metal material to a necessary pretreatment, and then a chemical conversion treatment is carried out. In other words, the term "surface conditioning treatment" referred to herein indicates a first phosphate treatment, which is a step for allowing metal phosphate particles to be adhered on a metal material surface. In addition, the term "chemical conversion treatment" indicates a second phosphate treatment subsequent to the surface conditioning treatment, which is a treatment for allowing the phosphate particles adhered on the metal material surface by the surface conditioning treatment to grow in the form of crystals. Moreover, the coating film of the metal phosphate formed by the surface conditioning treatment is herein referred to as a "phosphate coating film," while the coating film of metal phosphate particles formed by the chemical conversion treatment is referred to as a "chemical conversion coating film".

The present invention is explained below in detail.

[Composition for Surface Conditioning]

The surface conditioning composition of the present invention further improves the function of the surface conditioning composition to provide a surface conditioning composition of superior properties by adding (1) phenolic compounds to a surface conditioning composition containing bivalent or trivalent metal phosphate particles, and (2) a stabilizer. Moreover, many of these (1) phenolic compounds have antibacterial activity and degreasing power simultaneously, and therefore antibacterial agent and sterilizing equipment, which are used in many cases, are not necessary, and it is possible to prevent the repelling due to introducing oil in the previous step. The surface conditioning composition referred to herein indicates to include both a treatment liquid for surface conditioning that is used for the surface conditioning treatment, and a concentrated dispersion liquid that is used for producing the treatment liquid for surface conditioning through dilution.

The surface conditioning composition of the present invention includes bivalent or trivalent metal phosphate particles of which $D_{50}$ is no more than 3 μm, (1) a phenolic compound and (2) a stabilizer. As compared to conventionally known surface conditioning compositions, the surface conditioning composition of the present invention has superior dispersion stability in a treatment liquid for surface conditioning, is able to suppress electrolytic corrosion of metal materials during the chemical conversion treatment, and is able to form a sufficient amount of phosphate coating film even in a case of being applied to conversion resistant metal materials such as aluminum-based metal materials and high-tensile steel sheets.

The surface conditioning composition of the present invention contains (1) phenolic compound, and therefore zinc phosphate particles are very easily adsorbed to phosphate particles attached to the metal surface. Moreover, since the phenolic compound is low molecular weight, it is speculated that the pulverization/dispersion performance is not deteriorated, and that the metal phosphate particle is easily attached even to conversion resistant metal materials such as aluminum-based metal materials and high-tensile steel sheets, which are particularly likely to be affected by surface oxide films and the like, because of interactions (such as hydrogen bond and charging based on phenolic system hydroxy group) with the surface of the metal materials, resulting in superior chemical conversion performance.

In cases where a treatment liquid for surface conditioning including conventionally known phosphate particles of bivalent or trivalent metal is applied to conversion resistant metal materials such as aluminum-based metal materials and high-tensile steel sheets, a sufficient amount of chemical conversion coating film is not formed in a chemical conversion treatment, resulting in a problem in that sufficient corrosion resistance is not imparted to such metal materials. However, in cases where the surface conditioning composition of the present invention is used, it is possible to form a sufficient amount of coating film in a chemical conversion treatment, even to conversion resistant metal materials such as aluminum-based metal materials and high-tensile steel sheets.

This makes it possible to impart sufficient corrosion resistance even to the aforementioned metal materials. Moreover, in cases where the treatment liquid for surface conditioning of the present invention is applied to metal materials such as cold-rolled steel sheets and galvanized steel sheets, for which satisfactory corrosion resistance can be obtained with a conventional surface conditioning composition, it is possible to further increase the density of a chemical conversion coating film formed in the subsequent chemical conversion treatment, thereby further improving the corrosion resistance.

In addition, as metal materials for contacting the treatment liquid for surface conditioning, for example, iron- or zinc-based metal materials and aluminum-based metal materials are used simultaneously, and there may be a portion in which the iron- or zinc-based metal materials and the aluminum-based metal materials touch with each other. If a chemical conversion treatment is performed to such metal materials, at the time of the chemical conversion treatment, the aluminum-based metal material portion becomes an anode and the iron- or zinc-based metal material portion becomes a cathode at the contacting portion. As a result, a chemical conversion coating film may be difficult to be formed at the aluminum-based metal material portion at the touching portion.

In cases where the surface conditioning composition of the present invention is used, it is speculated that the chemical conversion treatment is accelerated by the increased amount of the phosphate film to be adhered to a treated product. As a result, as compared to cases where the conventional surface conditioning composition is used, it is speculated to be possible to suppress electrolytic corrosion at the aluminum-based metal material portion where the different kinds of metals (i.e. the iron- or zinc-based metal materials and the aluminum-based metal materials) contact with each other.

Due to this, if the surface conditioning is performed with the treatment liquid for surface conditioning of the present invention to metal materials having a portion where iron- or zinc-based metal materials and aluminum-based metal materials contact with each other, and subsequently a chemical conversion treatment is performed, it is possible to form a satisfactory chemical conversion coating film on the aluminum-based metal material portion at the contacting portion. Moreover, it is possible to form a satisfactory chemical conversion coating film on the surface of the conversion resistant metal materials.

[Phenolic Compound]

The surface conditioning composition of the present invention includes a (1) phenolic compound. Examples of the (1) phenolic compound include, e.g., compounds having at least two phenolic hydroxyl groups such as catechol, gallic acid, pyrogallol and tannic acid, or (1) phenolic compounds having a basic skeleton of the abovementioned compounds (for example, polyphenolic compounds involving flavonoid, tannin, catechin and the like, polyvinyl phenol as well as water soluble resol, novolak resins, and the like), lignin, and the like. Among them, tannin, gallic acid, catechin and pyrogallol are particularly preferred because the effect of the present invention is likely to be achieved. The aforementioned flavonoid is not particularly limited, and examples thereof include flavone, isoflavone, flavonol, flavanone, flavanol, anthocyanidin, aurone, chalcone, epigallocatechin gallate, gallocatechin, theaflavin, daidzin, genistin, rutin, myricitrin, and the like.

[Tannin]

The aforementioned tannin is a generic name of aromatic compounds which have a complicated structure having many phenolic hydroxyl groups, and which are widely distributed in the plant kingdom. The tannin may be either hydrolyzed tannin or condensed tannin.

Examples of the tannin include hamameli tannin, persimmon tannin, tea tannin, oak gall tannin, gallnut tannin, myrobalan tannin, divi-divi tannin, algarovilla tannin, valonia tannin, catechin tannin, and the like. The tannin may also be hydrolyzed tannin yielded by decomposition with a process such as hydrolysis or the like of tannin found in a plant.

Examples of the aforementioned tannin which may be used also include commercially available ones such as, e.g., "Tannic acid extract A," "B tannic acid," "N tannic acid," "Industrial tannic acid," "Purified tannic acid," "Hi tannic acid," "F tannic acid," "Official tannic acid" (all are trade names, manufactured by Dainippon Pharmaceutical Co., Ltd.), "Tannic acid: AL" (trade name, manufactured by Fuji Chemical Industry Co., Ltd.), and the like. In addition, at least two of the aforementioned tannins may be used in conjunction. The aforementioned lignin is a network polymer compound having a phenol derivative, to which a propyl group is bound as a base unit.

By using the aforementioned (1) phenolic compound in combination with the surface conditioning composition, the adhesion property of the metal phosphate particles to the metal material is improved. In particular, in addition to an improvement in the reactivity in the chemical conversion treatment of the conversion resistant aluminum-based metal materials, the stability of the surface conditioning composition is improved.

In other words, if the aforementioned (1) phenolic compound is added, the storage stability in the case of preservation for a long period of time in a concentrated dispersion liquid state, and the stability of the treatment liquid for surface conditioning are superior. In addition, even in cases where the liquid is contaminated with a hardening component such as a calcium ion, a magnesium ion or the like derived from tap water, it is difficult for the metal phosphate particles of the surface conditioning composition to aggregate.

[Content of Phenolic Compound]

The content of the aforementioned (1) phenolic compound in the concentrated dispersion liquid preferably has a lower limit of 0.01 parts by weight and an upper limit of 1000 parts by weight per 100 parts by weight of the solid content of the phosphate particles. When the content is less than 0.01 parts by weight, the adsorption to the phosphate particles is not sufficient; therefore, the effect of adhesion of the particles to the metal materials may not be obtained. Furthermore, a content of 1000 parts by weight or greater is not economical because an effect exceeding the desired effect cannot be achieved. With respect to the concentration, a lower limit of 0.1 parts by weight and an upper limit of 100 parts by weight are more preferred, and a lower limit of 0.5 parts by weight and an upper limit of 20 parts by weight are still more preferred. A particularly preferred concentration is a lower limit of 1 part by weight and an upper limit of 10 parts by weight.

It is preferred that a lower limit of 1 ppm and an upper limit of 1000 ppm be the content of the aforementioned (1) phenolic compound in the treatment liquid for surface conditioning. When the content is less than 1 ppm, the amount of adsorption to the metal phosphate particles is insufficient; therefore, adhesion of the metal phosphate particles to the metal material surface may not be facilitated. A content of greater than 1000 ppm is not economical because an effect exceeding the desired effect cannot be nevertheless achieved. With respect to the content, a lower limit of 5 ppm and an upper limit of 500 ppm are more preferred, and a lower limit of 10 ppm and an upper limit of 200 ppm are still more preferred. A particularly preferable upper limit of the content is 100 ppm.

[Metal Phosphate Particles]

The surface conditioning composition of the present invention contains bivalent or trivalent metal phosphate particles. The aforementioned metal phosphate particles are to be the crystal nuclei for acquiring a satisfactory chemical conversion coating film. It is speculated that the reaction for the chemical conversion treatment is accelerated by adhesion of these particles to the metal material surface.

The bivalent or trivalent metal phosphate particles are not particularly limited, and examples thereof include, e.g., particles of $Zn_3(PO_4)_2$, $Zn_2Fe(PO_4)_2$, $Zn_2Ni(PO_4)_2$, $Ni_3(PO_4)_2$, $Zn_2Mn(PO_4)_2$, $Mn_3(PO_4)_2$, $Mn_2Fe(PO_4)_2$, $Ca_3(PO_4)_2$, $Zn_2Ca(PO_4)_2$, $FePO_4$, $AlPO_4$, $CoPO_4$, $Co_3(PO_4)_2$, and the like. Among them, zinc phosphate particles are preferred in light of a similarity to the crystals of the coating film in the phosphoric acid treatment, particularly to zinc phosphate treatment, of the chemical conversion treatment.

[Particle Diameter of Metal Phosphate Particles]

The $D_{50}$ of the aforementioned bivalent or trivalent metal phosphate particles is no more than 3 μm. By setting $D_{50}$ to fall within the above range, it is possible to form a dense chemical conversion coating film. Moreover, if the particle diameter of the phosphate particles is larger, a problem may occur in that the metal phosphate particles are likely to form sediment in the treatment liquid for surface conditioning due to the specific gravity.

On the other hand, since the surface conditioning composition of the present invention contains the bivalent or trivalent metal phosphate particles with an average particle diameter represented by $D_{50}$ of no more than 3 μm, the dispersion stability in the treatment liquid for surface conditioning is superior, the sedimentation of the metal phosphate particles in the treatment liquid for surface conditioning can be suppressed, and a dense chemical conversion coating film can be formed after the chemical conversion treatment.

As for the $D_{50}$ of the metal phosphate particles, it is preferred that a lower limit be 0.01 μm, and an upper limit be 3 μm. A lower limit of the $D_{50}$ of less than 0.01 μm is not economical because of inferior productivity of the surface conditioning treatment. When it is greater than 3 μm, the surface conditioning function can not be sufficiently achieved, whereby the production efficiency of the chemical conversion treatment may be significantly reduced. More preferably, the lower limit is 0.1 μm and the upper limit is 1 μm.

$D_{90}$ of the metal phosphate particles is preferably no more than 4 μm. In this case, as for the metallic phosphate particles, in addition to $D_{50}$ being no greater than 3 μm, $D_{90}$ is no greater than 4 μm, and therefore the proportion of the presence of the coarse particles among the metallic phosphate particles comparatively decreases. As described above, by using metal phosphate particles with the $D_{50}$ no greater than 3 μm, it is possible to form a chemical conversion coating film that has minute phosphate crystals on a metal material surface in brief chemical conversion treatment.

However, when a means such as pulverizing is employed for providing dispersion with a diameter of no greater than 3 μm, excessive pulverizing may result in shortage of components that act as dispersant due to the increase of the specific surface area, and excessive-dispersion particles may reaggregate to form large particles, whereby stability of a metal phosphate particle dispersion liquid may be deteriorated. Moreover, depending on the compounding and dispersion conditions of the surface conditioning composition, a fluctuation in the dispersibility of the metal phosphate particles may be generated, leading to the probability of causing an increase in viscosity and reaggregation of the minute particles. On the other hand, when the $D_{90}$ of the metal phosphate particles is no greater than 4 μm, the occurrence of the foregoing problems can be suppressed.

As for $D_{90}$ of the metal phosphate particles, it is preferred that the lower limit be 0.01 μm and the upper limit be 4 μm. When the $D_{90}$ is less than 0.01 μm, reaggregation of the particles may occur. When the $D_{90}$ is greater than 4 μm, the proportion of minute metal phosphate particles is decreased, and therefore is not adequate. The lower limit is more preferably 0.05 μm, and the upper limit is more preferably 2 μm.

The $D_{50}$ (the diameter of the particles corresponding to 50% in terms of the volume) and the $D_{90}$ (the diameter of the particles corresponding to 90% in terms of the volume) are the diameters of the particle at the points of 50%, and 90%, respectively, in a cumulative curve as determined assuming that the total volume of the particles is 100% on the basis of the particle diameter distribution in the dispersion liquid. The $D_{50}$ can be measured by using an apparatus for measuring particle grade such as an optical diffraction type particle size analyzer ("LA-500," trade name, manufactured by Horiba, Ltd.). Herein, the description "average particle diameter" indicates the $D_{50}$.

[Content of Phosphate Particles]

In the treatment liquid for surface conditioning of the present invention, the content of the metal phosphate particles has preferably a lower limit of 50 ppm and an upper limit of 20000 ppm. When the content is less than 50 ppm, the metal phosphate particles to be the crystal nuclei may be deficient, and thus the surface conditioning effect may not be sufficiently achieved. A content of greater than 20000 ppm is not economical because an effect exceeding the desired effect can not be achieved. With respect to the content, a lower limit of 150 ppm and an upper limit of 10000 ppm are more preferred, and a lower limit of 250 ppm and an upper limit of 2500 ppm are still more preferred. With respect to the content, a lower limit of 500 ppm and an upper limit of 2000 ppm are more preferred.

[Stabilizer]

The aforementioned (2) stabilizer indicates a compound having an effect to improve dispersion stability of bivalent or trivalent metal phosphate particles in an aqueous solvent such as water. For such a compound, a well-known compound can be used, and examples thereof include phosphonic acid, phytic acid, polyphosphoric acid, a phosphonic acid group-containing acrylic resin and vinylic resin, a carboxyl group-containing acrylic resin and vinylic resin, saccharide, layered clay mineral, colloidal silica, acrylamide, etc. From the viewpoint that acquisition is easy, polyphosphoric acid, carboxyl group-containing acrylic resin, saccharide, layered clay mineral, colloidal silica, acrylamide, phosphonic acid, and phytic acid are preferred. In addition, two of these compounds may be used in combination.

[Carboxyl Group-containing Acrylic Resin and Vinylic Resin]

The carboxyl group-containing resin and vinylic resin are not particularly limited, and examples thereof include resins obtained by polymerization of an unsaturated monomer composition containing a carboxyl group-containing unsaturated monomer such as acrylic acid, methacrylic acid, maleic acid and fumaric acid. From the viewpoint that acquisition is easy, polyacrylic acid is preferred.

[Phosphonic Acid Group-Containing Acrylic Resin and Vinylic Resin]

The phosphonic acid group-containing acrylic resin and vinylic resin are not particularly limited, and examples thereof include resins obtained by polymerization of a monomer composition containing a phosphon group-containing ethylenic monomer such as 3-(meth)acryloxy propyl phosphonic acid.

[Saccharide]

The aforementioned saccharide is not particularly limited, and examples thereof include polysaccharides, polysaccharide derivatives, and alkali metal salts such as sodium salts and potassium salts thereof, and the like.

Examples of the polysaccharide include cellulose, methyl cellulose, ethyl cellulose, methylethyl cellulose, hemicellulose, starch, methyl starch, ethyl starch, methylethyl starch, agar, carrageen, alginic acid, pectic acid, guar gum, tamarind seed gum, locust bean gum, konjac mannan, dextran, xanthan gum, pullulan, gellan gum, chitin, chitosan, chondroitin sulfate, heparin, hyaluronic acid, and the like.

Examples of the polysaccharide derivative include carboxyalkylated or hydroxyalkylated polysaccharides described above such as carboxymethyl cellulose (CMC) and hydroxyethyl cellulose, starch glycolic acid, agar derivatives, carrageen derivatives, and the like. Carboxymethylcellulose is preferable because it is highly effective in improving dispersion stability.

[Layered Clay Mineral]

The layered clay mineral is not particularly limited, and examples thereof include layered polysilicic acid salts, e.g., smectites such as montmorillonite, beidellite, saponite, and hectorite; kaolinites such as kaolinite, and halloysite; vermiculites such as dioctahedral vermiculite, and trioctahedral vermiculite; micas such as teniolite, tetrasilicic mica, muscovite, illite, sericite, phlogopite, and biotite; hydrotalcite; pyrophilolite; kanemite, makatite, ilerite, magadiite, and kenyaite, and the like. These layered clay minerals may be either a naturally occurring mineral, or a synthetic mineral yielded by hydrothermal synthesis, a melt process, a solid phase process or the like.

Above all, smectites are preferable, and natural hectorites and/or synthetic hectorites are more preferable because they are highly effective in improving dispersion stability. Accordingly, more superior dispersion stability can be imparted to the concentrated dispersion liquid, and also the dispersion efficiency can be enhanced.

The aforementioned (2) stabilizer is negatively charged in solution. When the stabilizer is absorbed in the surface of the bivalent or trivalent metal phosphate particles, the bivalent or trivalent metal phosphate particles repel one another, whereby the particles do not gather excessively as crystal nuclei. As a result, the particles are allowed to adhere on the metal material surface at uniform density. It is speculated that this forms a superior chemical conversion coating film in a chemical conversion treatment.

The aforementioned (2) stabilizer prevents not only sedimentation of zinc phosphate particles in the treatment liquid for surface conditioning, but also sedimentation of zinc phosphate particles in the concentrated dispersion liquid, thereby making it possible to maintain long-term dispersion stability of the concentrated dispersion liquid.

[Content of Stabilizer]

The content of the aforementioned (2) stabilizer in the concentrated dispersion liquid has preferably a lower limit of 0.01 parts by weight and an upper limit of 1000 parts by weight per 100 parts by weight of the solid content of the phosphate particles. When the content is less than 0.01 parts by weight, the sedimentation-preventing effect may not be sufficiently achieved. Furthermore, a content of 1000 parts by weight or greater is not economical because an effect exceeding the desired effect cannot be achieved. With respect to the content, a lower limit of 0.1 parts by weight and an upper limit of 100 parts by weight are more preferred, and a lower limit of 0.5 parts by weight and an upper limit of 25 parts by weight are still more preferred. With respect to the content, a lower limit of 1 part by weight and an upper limit of 10 parts by weight are particularly preferred.

With respect to the content of the aforementioned (2) stabilizer in the treatment liquid for surface conditioning, a lower limit of 1 ppm and an upper limit of 1000 ppm are preferred. When the content is less than 1 ppm, the effect as the aforementioned (2) stabilizer may not be sufficiently achieved. A content of greater than 1000 ppm is not economical because an effect exceeding the desired effect cannot be nevertheless achieved. With respect to the content, a lower limit of 10 ppm and an upper limit of 500 ppm are more preferred, and a lower limit of 10 ppm and an upper limit of 200 ppm are still more preferred. The particularly preferable upper limit of the content is 100 ppm. It should be noted that two or more kinds of the aforementioned (2) stabilizer may be used in combination.

[Chelating Agent and/or Surfactant]

The surface conditioning composition of the present invention may further include a chelating agent and/or a surfactant. By including the chelating agent, even in cases where hardening components, such as calcium ions and magnesium ions present in tap water, contaminate the surface conditioning composition, aggregation of the metal phosphate particles is suppressed, thereby making it possible to improve the stability of the surface conditioning treatment bath.

[Chelating Agent]

The chelating agent is not particularly limited as long as the chelating agent can form chelate with hardening components such as calcium ions and magnesium ions, and examples thereof include citric acid, tartaric acid, pyrophosphate, tripolyphosphate Na, EDTA, gluconic acid, succinic acid and malic acid, and compounds and derivative thereof.

[Content of Chelating Agent]

The content of the chelating agent in the treatment liquid for surface conditioning is preferably between a lower limit of 1 ppm and an upper limit of 10000 ppm. When the content is less than 1 ppm, hardening components in tap water cannot be sufficiently chelated, and thus metal cations such as calcium ions that are the hardening components may cause aggregation of the metal phosphate particles. Even if the content is greater than 10000 ppm, an effect exceeding the desired effect cannot be achieved, and it is probable that a reaction with the active ingredient of the chemical conversion treatment liquid may occur to thereby inhibit the chemical conversion treatment reaction. With respect to the content, a lower limit of 10 ppm and an upper limit of 1000 ppm are more preferred. A more preferable upper limit of the content is 200 ppm.

[Surfactant]

The aforementioned surfactant is more preferably an anionic surfactant or a nonionic surfactant. The anionic surfactant or the nonionic surfactant is contained in the surface conditioning composition of the present invention. Accordingly, in the chemical conversion treatment after the surface conditioning treatment, it is possible to form a sufficient amount of satisfactory chemical conversion coating film at the aluminum-based metal material portion of the electrolytic corrosion portion made of the iron- or zinc-based metal materials and the aluminum-based metal materials. This makes it possible to reduce the difference in the amount of the chemical conversion coating films of the general portion and the electrolytic corrosion portion. Moreover, it is possible to form a dense chemical conversion coating film on various metal material surfaces. Furthermore, it is possible to form a sufficient amount of chemical conversion coating film even on conversion resistant metal materials such as the aluminum-based metal materials and the high-tensile steel sheet.

The aforementioned nonionic surfactant is not particularly limited, but nonionic surfactants having a hydrophilic lipophilic balance (HLB) of 6 or greater are preferred, examples thereof including polyoxyethylene alkyl ether, polyoxyalkylene alkyl ether, polyoxyethylene derivatives, oxyethylene-oxypropylene block copolymers, sorbitan fatty acid esters, polyoxyethylene sorbitan fatty acid esters, polyoxyethylene sorbitol fatty acid esters, glycerin fatty acid esters, polyoxyethylene fatty acid esters, polyoxyethylene alkylamine, alkylalkanode amide, nonylphenol, alkylnonylphenol, polyoxyalkylene glycol, alkylamine oxide, acetylene diol, polyoxyethylene nonylphenyl ether, silicon based surfactants such as polyoxyethylene alkylphenyl ether-modified silicone, fluorine-based surfactants prepared through substitution of at least one hydrogen atom in a hydrophobic group of a hydrocarbon-based surfactant with a fluorine atom, and the like. Among them, polyoxyethylene alkyl ether and polyoxyalkylene alkyl ether are preferred in light of obtaining further improved effects of the present invention. These may be used alone, or two or more may be used in combination.

The anionic surfactant is not particularly limited, and examples thereof include, e.g., fatty acid salts, alkylsulfuric acid ester salts, alkyl ether sulfuric acid ester salts, alkylbenzene sulfonate, alkylnaphthalene sulfonate, alkylsulfosuccinate, alkyldiphenyl ether disulfonate, polybisphenol sulfonate, alkylphosphate, polyoxyethylalkyl sulfuric acid ester salts, polyoxyethylalkylallylsulfuric acid ester salts, alpha-olefin sulfonate, methyl taurine acid salts, polyaspartate, ether carboxylate, naphthalene sulfonic acid-formalin condensates, polyoxyethylene alkylphosphate esters, alkyl ether phosphoric acid ester salts, and the like. Among them, alkyl ether phosphoric acid ester salts are preferred in light of obtaining further improved effects of the present invention.

The anionic surfactants can be used after neutralization with ammonia or amine based neutralizing agent. Examples of the amine based neutralizing agent include, e.g., diethylamine (DEA), triethylamine (TEA), monoethanolamine (META), diethanolamine (DETA), triethanolamine (TETA), dimethylethanolamine (DMEA), diethylethanolamine (DEEA), isopropylethanolamine (IPEA), diisopropanolamine (DIPA), 2-amino-2-methylpropanol (AMP), 2-(dimethylamino)-2-methylpropanol (DMAMP), morpholine (MOR), N-methylmorpholine (NMM), N-ethylmorpholine (NEM), and the like. Among them, 2-amino-2-methylpropanol (AMP) is preferably used.

[Content of Surfactant]

With respect to the content of the anionic surfactant or the nonionic surfactant in the treatment liquid for surface conditioning, a lower limit of 3 ppm and an upper limit of 500 ppm are preferred. When the content falls within the above range, the effect of the present invention can be favorably achieved. The lower limit is more preferably 5 ppm, while the upper limit is more preferably 300 ppm. These may be used alone, or two or more may be used in combination.

[Metal Nitrite]

A bivalent or trivalent metal nitrite can be added to the surface conditioning composition as needed to still further suppress the generation of rust.

[Dispersion Medium]

The surface conditioning composition can contain a dispersion medium for allowing the aforementioned bivalent or trivalent metal phosphate particles to be dispersed. Examples of the dispersion medium include an aqueous medium including at least 80% by mass of water. Various water soluble organic solvents can be used as the medium other than water; however, the content of the organic solvent is desired to be as low as possible, and accounts for preferably no more than 10% by mass of the aqueous medium, and more preferably no more than 5% by mass. Dispersion liquid including water alone is also acceptable.

The water soluble organic solvent is not particularly limited, and examples thereof include, e.g., alcoholic solvents such as methanol, ethanol, isopropanol and ethyleneglycol; ether based solvents such as ethyleneglycol monopropyl ether, butylglycol and 1-methoxy-2-propanol; ketone based solvents such as acetone and diacetone alcohol; amide based solvents such as dimethylacetamide and methylpyrrolidone; ether based solvents such as ethylcarbitol acetate, and the like. These may be used alone, or two or more may be used in combination.

[Alkali Salt]

To the surface conditioning composition, an alkali salt such as soda ash may be added for the purpose of further stabilizing the bivalent or trivalent metal phosphate particles in the dispersion medium to form a minute chemical conversion coating film in the chemical conversion treatment step subsequently carried out.

With respect to the aforementioned various additives, the kind, amount of addition and the like may be freely selected.

[pH of Surface Conditioning Composition]

With regard to the pH of the aforementioned surface conditioning composition, a lower limit of 3 and an upper limit of 12 are preferred. When the pH is less than 3, the bivalent or trivalent metal phosphate particles become likely to be readily dissolved and unstable, which may affect the subsequent step. When the pH is greater than 12, the pH of the chemical conversion treatment bath in the subsequent step may increase, which may lead to defective chemical conversion. The lower limit of the pH of the surface conditioning composition is preferably 6, while the upper limit is preferably 11.

[Method for Producing Metal Surface Conditioning Composition]

The surface conditioning composition of the present invention can be produced, for example, by the following method. When zinc phosphate is used as the bivalent or trivalent metal phosphate particles, zinc phosphate particles can be obtained, for example, by using zinc phosphate as a raw material. The zinc phosphate of the raw material is represented as $Zn_3(PO_4)_2.4H_2O$, is generally a crystalline solid with no color, and is commercially available as a white powder.

As a method for producing the zinc phosphate of the raw material, for example, diluted liquids of zinc sulfate and disodium hydrogenphosphate are mixed at a molar ratio of 3:2 followed by heating, and tetrahydrate of the zinc phosphate is generated as crystalline precipitates. Moreover, tetrahydrate of the zinc phosphate can also be obtained by reacting a diluted phosphoric acid aqueous solution and zinc oxide or zinc carbonate. The crystal of the tetrahydrate is an orthorhombic system, and has three kinds of confirmations. When heated, it becomes a dehydrate at 100 degrees Celsius, monohydrate at 190 degrees Celsius, and nonhydrate at 250 degrees Celsius. As the zinc phosphate in the present invention, any of the tetrahydrate, dihydrate, monohydrate and nonhydrate is available, but use of the tetrahydrate suffices as it is, which is generally easy to obtain.

The form of the bivalent or trivalent metal phosphate particles of the raw material is not particularly limited, but one having any arbitrary form can be used. Although commercially available products are generally in the state of a white powder, the form of the powder may be any one such as fine particulate, platy, squamous, or the like. Furthermore, the particle diameter of the bivalent or trivalent metal phosphate particles of the raw material is not particularly limited, but in general, powders exhibiting an average particle diameter of approximately several micrometers (μm) may be used. Particularly, commercially available products as rust preventive pigments may be suitably used such as products having an improved buffering action by subjecting to a treatment for imparting basicity.

As discussed later, in the present invention, a stable concentrated dispersion liquid can be prepared in which the bivalent or trivalent metal phosphate particles are dispersed in a dispersion medium, and therefore it is possible to obtain a stable surface conditioning effect irrespective of the primary particle diameter or form of the bivalent or trivalent metal phosphate particles of the raw material.

It is preferred that the bivalent or trivalent metal phosphate particles be prepared and used in a state of being finely dispersed in the dispersion medium. The method for preparing the concentrated dispersion liquid, in which the bivalent or trivalent metal phosphate particles are dispersed in an aqueous medium, is not limited, but it is preferably achieved by mixing the bivalent or trivalent metal phosphate particles of the raw material in the aforementioned dispersion medium such as water or a water-soluble organic solvent, and performing wet pulverization in the presence of the aforementioned (1) phenolic compound and the (2) stabilizer. Moreover, the aforementioned (1) phenolic compound may be added as necessary after preparing or diluting the concentrated dispersion liquid.

It should be noted that, in order to obtain the concentrated dispersion liquid of the bivalent or trivalent metal phosphate particles, it is convenient in terms of steps to perform wet pulverization of the bivalent or trivalent metal phosphate of the raw material together with the aqueous medium at the time of preparing the concentrated dispersion liquid; however, the concentrated dispersion liquid may also be prepared by solvent replacement after performing wet pulverization in a dispersion medium other than the concentrated medium.

In the preparation of the concentrated dispersion liquid, the amount of the bivalent or trivalent metal phosphate of the raw material in the concentrated dispersion liquid is preferably, in general, between a lower limit of 0.5% by mass and an upper limit of 50% by mass. When the amount is less than 0.5% by mass, the effect of the treatment liquid for surface conditioning that is prepared by the concentrated dispersion liquid may not be sufficiently achieved because the content of the bivalent or trivalent metal phosphate is too low. When the amount is greater than 50% by mass, it becomes difficult to obtain uniform and minute particle diameter distribution by wet pulverization, and the bivalent or trivalent metal phosphate particles may tend to reaggregate. With respect to the content, a lower limit of 1% by mass and an upper limit of 40% by mass are more preferred, and a lower limit of 10% by mass and an upper limit of 30% by mass are particularly preferred.

With respect to the amount of addition of the aforementioned (1) phenolic compound and (2) stabilizer in the concentrated dispersion liquid, a lower limit of 0.1% by mass and an upper limit of 50% by mass are preferred. When the content is less than 0.1% by mass, a concentrated dispersion liquid, which is preferable for the preparation of a treatment liquid for surface conditioning, may not be obtained. When the amount is greater than 50% by mass, dispersibility may be deteriorated due to the influence of the aforementioned (1) phenolic compound and/or the aforementioned (2) stabilizer being excessive, and it is not economical even if the dispersion is satisfactory. The lower limit is more preferably 0.5% by mass, while the upper limit is more preferably 20% by mass.

The method for obtaining the concentrated dispersion liquid, in which the bivalent or trivalent metal phosphate particles are finely dispersed with the $D_{50}$ being no more than 3 μm, is not limited, but preferably, 0.5 to 50% by mass of the bivalent or trivalent metal phosphate of the raw material, and 0.1 to 50% by mass of the aforementioned (1) phenolic compound and (2) stabilizer are made to be present in a dispersion medium, and wet pulverization is performed. The method of wet pulverization is not particularly limited, and a means of general wet pulverization may be used; for example, any one of beads mills typified by the disc type, pin type and the like, high-pressure homogenizers, medialess dispersion machines typified by ultrasonic dispersion machines can be used.

In the wet pulverization, by monitoring the $D_{90}$ of the bivalent or trivalent metal phosphate particles, excessive dispersion can be prevented, and the aggregation as well as thickening or reaggregation of minute particles can be prevented. In the present invention, it is preferable to set the $D_{90}$ at no more than 4 μm. In addition, it is desirable to select compounding and dispersion conditions which do not cause excessive dispersion.

By the aforementioned method for producing the concentrated dispersion liquid, the $D_{50}$ of the bivalent or trivalent metal phosphate particles can be regulated in the range of no more than 3 μm in the aqueous medium. Accordingly, it is possible to obtain a concentrated dispersion liquid which is superior in stability and which has superior performance as a surface conditioning composition. The $D_{50}$ can be regulated to a desired average particle diameter in a range of 0.01 to 3 μm.

By preparing a concentrated dispersion liquid by the aforementioned methods for preparing the concentrated dispersion liquid, even bivalent or trivalent metal phosphate of more than 3 μm can be dispersed in a liquid in a state where the $D_{50}$ is no more than 3 μm. The above applies even to the bivalent or trivalent metal phosphate having a primary particle size on the order of dozens of μm. This is because the primary particle diameter of the metal phosphate particles can be decreased by conducting wet pulverization according to the process as described above, without using bivalent or trivalent metal phosphate originally having a small primary particle diameter. According to the aforementioned method, the $D_{50}$ of the bivalent or trivalent metal phosphate particles in the concentrated dispersion liquid can be 3 μm or less, or further, 1 μm or less, or still further, 0.2 μm or less.

In the aforementioned concentrated dispersion liquid, the $D_{50}$ of the bivalent or trivalent metal phosphate particles in the liquid can be regulated to be in the range of 0.01 to 3 μm to meet the intended use. Accordingly, this is a concentration dispersion liquid that is superior in dispersion stability.

Since the proportion of the large particles of a particle diameter of greater than the $D_{90}$ can be reduced by the wet pulverization method, it is possible to produce a concentrated dispersion liquid which has a sharp particle diameter distribution, in which the mixing of particles with a large dispersion diameter is suppressed, and in which the $D_{90}$ is particularly no more than 4 μm, or further, 2.6 μm or less, or still further, 0.3 μm or less. Accordingly, it is speculated that the bivalent or trivalent metal phosphate particles are finely dispersed in the aqueous medium, and that the dispersion state is stable. Moreover, since the proportion of large particles is low, it is speculated that the bivalent or trivalent metal phosphate particles in the surface conditioning composition efficiently contribute to the generation of crystal nuclei. Since the particle diameter distribution is sharp, it is speculated that crystal nuclei with more uniform and fine particle diameters are formed in the surface conditioning treatment step, and a more uniform chemical conversion coating film is formed in the subsequent chemical conversion treatment step, thereby forming a uniform and superior chemical conversion coating film on the surface of the obtained chemical conversion treatment steel sheet. Furthermore, it is speculated that this improves treatment performances on bag-shaped parts of members with a complex structure as well as on the conversion resistant metal materials such as aluminum-based metal materials and high-tensile steel sheets.

As for the aforementioned concentration dispersion liquid, a concentration dispersion liquid with high concentration can also be obtained in which the bivalent or trivalent metal phosphate is blended in an amount of at least 10% by mass, further, at least 20% by mass, and still further, at least 30% by mass. This makes it possible to easily prepare a treatment liquid for surface conditioning which achieves high performance.

Other components (bivalent or trivalent metal nitrite, a dispersion medium, a thickening agent, and the like) can also be admixed into the concentrated dispersion liquid obtained as described above. The method of mixing the concentrated dispersion liquid with the other component is not particularly limited but, for example, the other component may be added to and mixed with the concentrated dispersion liquid, or the other component may be blended during preparation of the concentrated dispersion liquid.

The treatment liquid for surface conditioning is prepared by, for example, diluting the aforementioned concentrated dispersion liquid in an aqueous medium such as water. The treatment liquid for surface conditioning is superior in dispersion stability, and favorable surface treatment can thereby be done to the metal material. The aforementioned (1) phenolic compound may be added to an aqueous medium at the same time of adding the bivalent or trivalent metal phosphate, or may be added to the concentrated dispersion liquid in which the bivalent or trivalent metal phosphate has been dispersed, or may be added after dilution of the concentrated dispersion liquid.

[Method for Surface Conditioning]

The method for surface conditioning of the present invention includes a step of bringing the treatment liquid for surface conditioning, which is the surface conditioning composition, to be in contact with a metal surface. Hence, minute particles of the bivalent or trivalent metal phosphate can adhere to the surface of not only the iron- and zinc-based metal materials, but also conversion resistant metal materials such as aluminum-based metal materials and high-tensile steel sheets, and a sufficient amount of chemical conversion coating film can be formed in the chemical conversion treatment step. In addition, multiple kinds of metal materials such as, for example, an iron- or zinc-based metal material and an aluminum-based metal material, can be concurrently treated for surface conditioning, and thus a chemical conversion coating film can be formed in a more favorable manner.

The process for bringing the treatment liquid for surface conditioning into contact with the metal material surface in the above method for surface conditioning is not particularly limited, but a conventionally known method such as dipping or spraying can be freely employed.

The metal material to be subjected to the surface conditioning is not particularly limited, and the process is applicable to a variety of metals generally subjected to the chemical conversion treatment, such as, for example, galvanized steel sheets, aluminum-based metal materials, magnesium alloys, or iron-based metal materials such as cold-rolled steel sheets and high-tensile steel sheets. Furthermore, it is suitably applicable to usage by which multiple kinds of metal materials such as, for example, an iron steel or galvanized steel sheet and an aluminum-based metal material are simultaneously subjected to the treatment.

Moreover, using the surface conditioning composition of the present invention, a step of surface conditioning in combination with degreasing can be carried out. Accordingly, the step for washing with water following a degreasing treatment can be omitted. In the aforementioned step of surface conditioning in combination with degreasing, a known inorganic alkali builder, an organic builder or the like may be added for the purpose of increasing the detergency. In addition, a known condensed phosphate or the like may be added. In the surface conditioning step as described above, the contact time of the surface conditioning composition with the metal material surface and the temperature of the surface conditioning composition are not particularly limited, but the process can be performed under conventionally known conditions.

After performing the surface conditioning, the chemical conversion treatment is carried out with a chemical conversion treatment agent containing phosphate to enable production of a chemical conversion treated metal sheet. The process for the chemical conversion treatment is not particularly limited, but any one of various known processes such as a dipping treatment, a spraying treatment, or an electrolytic treatment can be employed. Multiple kinds of these treatments may be conducted in combination. Furthermore, with regard to the phosphate constituting the metal chemical conversion coating film to be deposited, it is not particularly limited as long as it is a metal phosphate, and examples thereof include zinc phosphate, iron phosphate, manganese phosphate, zinc-calcium phosphate and the like, but are not limited thereto. Among them, zinc phosphate is preferred. In the chemical conversion treatment, the contact time of the chemical conversion treatment agent with the metal material surface, and the temperature of the chemical conversion treatment agent are not particularly limited, and the treatment can be performed under conventionally known conditions.

After carrying out the aforementioned surface conditioning and the aforementioned chemical conversion treatment, a coated steel sheet can be produced by further carrying out coating. The coating process is generally electrodeposition coating.

The solution for use in the coating is not particularly limited, but may be of various types generally used in coating of a chemical conversion treated steel sheet, and examples thereof include, e.g., epoxymelamine solutions, as well as solutions for cation electrodeposition, polyester-based intermediate coating solutions and polyester-based top coating solutions, and the like. Known processes may be employed in which a washing step is carried out after the chemical conversion treatment, and prior to the coating.

The surface conditioning composition of the present invention contains the bivalent or trivalent metal phosphate particles with the $D_{50}$ of no more than 3 μm, has pH of 3 to 12, and contains the (1) phenolic compound and (2) stabilizer. Accordingly, in cases where surface conditioning is performed, with the treatment liquid for surface conditioning, on metal materials having a contacting portion of different kinds of metals such as an iron- or zinc-based metal material and an aluminum-based metal material, and subsequently the chemical conversion treatment is performed, a sufficient amount of chemical conversion coating film can be formed on the aluminum-based metal material of the contacting portion of different kinds of metals. Furthermore, a sufficient amount of chemical conversion coating film can be formed even in cases where it is applied to conversion resistant metal materials such as aluminum-based metal materials and high-tensile steel sheets.

Moreover, the use of a particular component makes it possible to facilitate the formation of a chemical conversion coating film on a metal material surface, and to form a dense chemical conversion coating film. Furthermore, since the bivalent or trivalent metal phosphate particles with the $D_{50}$ of no more than 3 μm are contained, the dispersion stability in the treatment liquid for surface conditioning is superior.

Therefore, the surface conditioning composition can be preferably used for surface conditioning of various metal materials.

Effects of the Invention

Since the surface conditioning composition of the present invention is constituted as described above, in cases where the composition is applied to metal materials such as iron, zinc and aluminum, and particularly in cases where the composition is applied to conversion resistant metal materials such as aluminum-based metal materials or high-tensile steel sheets in a surface conditioning treatment, it is possible to form a sufficient amount of chemical conversion coating film on the metal material surface in a subsequent chemical conversion treatment, and the dispersion stability in the treatment liquid for surface conditioning is superior, thereby making it possible to suppress electrolytic corrosion on the metal materials during the chemical conversion treatment.

In addition, it is also superior in dispersion stability. The surface conditioning composition of the present invention can be suitably used for a variety of metal materials which have been employed in automotive bodies, home electric appliances, and the like.

PREFERRED MODE FOR CARRYING OUT THE INVENTION

Figure 1:
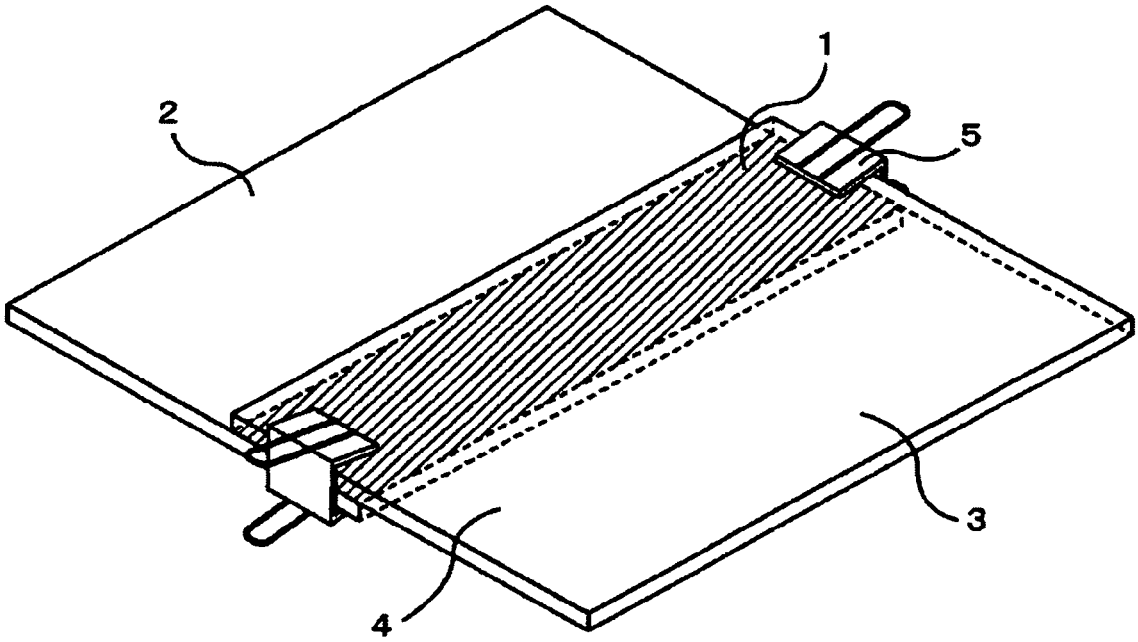
FIG. 1 shows a schematic drawing of an electrolytic corrosion aluminum test sheet used in the Examples.

The present invention is explained in more detail below by way of Examples, but the present invention is not limited only to these Examples. In the following Examples, "part" or "%" each represents "part by mass" or "% by mass," respectively, unless otherwise specified. It should be noted that the $D_{50}$ (the method for measurement thereof is as follows) of zinc phosphate particles in the surface conditioning composition of Examples 1 to 9 and Comparative Examples 1 to 6, to be described below, is shown in Table 1. Moreover, in the surface conditioning treatment, the treatment liquid actually brought into contact with the metal material is referred to as "treatment liquid for surface conditioning," while the dispersion liquid of the metal phosphate particles for use in producing the treatment liquid for surface conditioning through dilution is referred to as "concentrated dispersion liquid". The treatment liquid for surface conditioning is obtained by diluting the concentrated dispersion liquid with a solvent such as water to give a predetermined concentration, and adding the necessary additives, followed by adjusting the pH.

EXAMPLE 1

Preparation of Surface Conditioning Composition

To 60 parts by mass of pure water were added 1 part by mass of pyrogallol, 1 part by mass of polyphosphoric acid ("SN2060," trade name, manufactured by San Nopco Limited) based on the solid content, and 20 parts by mass of zinc phosphate particles. To the mixture was added pure water to make 100 parts by mass. The mixture was allowed to disperse with an SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

EXAMPLES 2 AND 3

Preparation of Surface Conditioning Composition

A treatment liquid for surface conditioning was prepared similarly to Example 1, except that the kinds of (1) phenolic compound and (2) stabilizer were changed as shown in Table 1.

EXAMPLE 4

Preparation of Surface Conditioning Composition

To 60 parts by mass of pure water were added 1 part by mass of "SN2060" (above mentioned) based on the solid content, and 20 parts by mass of zinc phosphate particles. To this mixture was added water to make a total amount of 100 parts by mass. The mixture was allowed to disperse with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

EXAMPLE 5

Preparation of Surface Conditioning Composition

To 60 parts by mass of pure water were added 1 part by mass of tannic acid (reagent), 1 part by mass of "SN2060" (above mentioned) based on the solid content, and 20 parts by mass of zinc phosphate particles. To this mixture was added water to make a total amount of 100 parts by mass, followed by neutralization with NaOH. The mixture was allowed to disperse with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

EXAMPLE 6

Preparation of Surface Conditioning Composition

To 60 parts by mass of pure water were added 20 parts by mass of pyrogallol, 1 part by mass of "SN2060" (above mentioned) based on the solid content, 1 part by mass of smectite ("Kunipia F," trade name, Kunimine Industries Co., Ltd.), and 20 parts by mass of zinc phosphate particles. To the mixture was added pure water to make 100 parts by mass. The mixture was allowed to disperse with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

EXAMPLES 7 AND 8

Preparation of Surface Conditioning Composition

A treatment liquid for surface conditioning was prepared similarly to Example 6, except that the kinds of (1) phenolic compound and (2) stabilizer were changed as shown in Table 1.

EXAMPLE 9

Preparation of Surface Conditioning Composition

To 60 parts by mass of pure water were added 1 part by mass of tannic acid (reagent), 1 part by mass of polyphosphoric acid based on the solid content, 1 part by mass of an urethane resin ("TAFIGEL PUR40," trade name, manufactured by Kusumoto Chemicals, Ltd.), and 20 parts by mass of zinc phosphate particles. To this mixture was added water to make a total amount of 100 parts by mass, followed by neutralization with NaOH. The mixture was allowed to disperse with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

Comparative Example 1

Preparation of Surface Conditioning Composition

To 60 parts by mass of pure water were added 1 part by mass of "SN2060" (above mentioned) based on the solid content, and 20 parts by mass of zinc phosphate particles. To this mixture was added water to make a total amount of 100 parts by mass. The mixture was allowed to disperse with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

Comparative Examples 2 and 3

Preparation of Surface Conditioning Composition

A treatment liquid for a metal surface was prepared similarly to Comparative Example 1, except that the kind of (2) stabilizer was changed as shown in Table 1.

Comparative Example 4

Preparation of Surface Conditioning Composition

To 60 parts by mass of pure water were added 1 part by mass of polyacrylic acid ("SN44C," trade name, manufactured by San Nopco Limited) based on the solid content, and 20 parts by mass of zinc phosphate particles. To the mixture was added pure water to make 100 parts by mass. The mixture was allowed to disperse with the SG mill for 180 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

Comparative Example 5

Preparation of Surface Conditioning Composition

To 60 parts by mass of pure water were added 1 part by mass of "SN44C" (above described) based on the solid content, 1 part by mass of colloidal silica ("SNOWTEX N," trade name, manufactured by Nissan Chemical Industries, Ltd.) based on the solid content, and 20 parts by mass of zinc phosphate particles. To the mixture was added pure water to make 100 parts by mass. The mixture was allowed to disperse with the SG mill for 360 min at a filling ratio of zirconia beads (1 mm) of 80%. The resulting concentrated dispersion liquid was diluted with tap water to give a zinc phosphate concentration of 0.1%, and the treatment liquid for surface conditioning was obtained through adjusting the pH to be 9 with NaOH.

Comparative Example 6

Preparation of Surface Conditioning Composition

A titanium-phosphate-based powder surface conditioning agent ("5N10", trade name, manufactured by NIPPON PAINT CO., LTD.) was diluted with tap water to 0.1%, and the pH was adjusted to 9 with NaOH.

Examples 1 to 9 and Comparative Examples 1 to 6

[Production of Test Sheet 1]

A cold-rolled steel sheet (SPC) (70 mm×150 mm×0.8 mm), an aluminum sheet (Al) (#6000 series, 70 mm×150 mm×0.8 mm), a galvanized steel sheet (GA) (70 mm×150 mm×0.8 mm), and a high-tensile steel sheet (70 mm×150 mm×1.0 mm) were, respectively, subjected to a degreasing treatment using a degreasing agent ("SURFCLEANER EC92", trade name, 2%, manufactured by NIPPON PAINT CO., LTD.) at 40 degrees Celsius for 2 min. Then, using the treatment liquid for surface conditioning obtained in Examples and Comparative Examples, the surface conditioning treatment was carried out at room temperature for 30 sec. Subsequently, each steel sheet was subjected to a chemical conversion treatment using a zinc phosphate treatment liquid ("SURFDINE SD6350", trade name, manufactured by NIPPON PAINT CO., LTD.) with a dipping method at 35 degrees Celsius for 120 sec, followed by washing with water, washing with pure water, and drying to obtain a test sheet.

[Production of Test Sheet 2]

Similarly to the aforementioned Production of Test Sheet 1, an aluminum sheet 3 and a galvanized steel sheet 2 subjected to the degreasing treatment were produced, and the aluminum sheet 3 and the galvanized steel sheet 2 following the degreasing treatment were joined using a clip 5 as shown in FIG. 1. Next, the joined metal sheets were subjected, similarly to Production of Test Sheet 1, to the surface conditioning treatment, a chemical conversion treatment, washing with water, washing with pure water, and drying to obtain the test sheet. The composition ratios of the treatment liquids for surface conditioning obtained as in the foregoing are shown in Table 1.

[Evaluation Test]

Evaluation was performed by the following method, and the result is shown in Table 2. With respect to the steel sheet produced in the "Production of Test Sheet 2", the evaluation was made on a part of the electrolytic corrosion 1 of the aluminum sheet 3. In Table 2, those produced in "Production of Test Sheet 1" are designated as "SPC," "GA," "Al," and "high-tensile steel sheet," while those produced in "Production of Test Sheet 2" are designated as "Al (part of electrolytic corrosion)".

[Determination of Particle Diameter of Zinc Phosphate Particles]

With respect to particle diameters of the zinc phosphate particles included in the treatment liquid for surface conditioning obtained in the Examples or Comparative Examples, the particle diameter distribution was determined using an optical diffraction type particle size analyzer ("LA-500", trade name, manufactured by Horiba, Ltd.), and the $D_{50}$ (average particle diameter of dispersion) and $D_{90}$ were monitored to determine the $D_{50}$ and $D_{90}$.

[Appearance of Coating Film]

The appearance of the formed coating film was visually evaluated on the basis of the following standards. In addition, the presence or absence of the generation of rust after the drying was visually observed. In cases where rust was generated, it was designated as "partly rusted" or "rusted" depending on the degree of rusting.

A: uniformly and minutely covering the entire face
B: roughly covering the entire face
C: parts were not covered
D: no substantial chemical conversion coating film formed In addition, the size of the crystals of the formed chemical conversion coating film was measured with an electron microscope.

[Amount of Adhesion]

After subjecting to the surface conditioning treatment and subsequently standing still for one hour followed by drying, the amounts of the adhesion of phosphate particles were determined with a fluorescent X-ray measurement apparatus ("XRF-1700", trade name, manufactured by Shimadzu Corporation).

[Amount of Chemical Conversion Coating Film (C/W)]

Amounts of chemical conversion coating films of SPC sheet and GA sheet were determined by "XRF-1700" (mentioned above).

When the metal materials that were comparatively superior in chemical conversion treatment capability such as SPC and GA were used, the chemical conversion performance is considered to be higher as the crystal particle diameter is smaller and as the amount of coating film is smaller, because formation of crystals as dense as possible is desired. In contrast, in the cases of conversion resistant metal materials such as the aluminum-based metal materials and the high-tensile steel sheets, an increase in the amount of the crystal coating film is required because of low chemical conversion treatment performance. Consequently, it has been determined that when there is a higher amount of coating film, the chemical conversion performance is high.

[Stability]

In regards to the stability of the treatment liquid for surface conditioning in cases where the degreasing treatment liquid in the prior step was mixed in with the treatment liquid for surface conditioning obtained in the Examples, the following was performed on the assumption that the treatment liquid for surface conditioning was contaminated. The degreasing treatment liquid (mentioned above) that was diluted to 1/100 and mixed in with treatment liquid for surface conditioning was placed in an incubator at 30 degrees Celsius for 90 days, and the resulting chemical conversion property of SPC was evaluated and compared with the initial property, thereby evaluating with the standards as follows. It should be noted that the decomposed treatment liquid for surface conditioning was indicated as "decomposed."

A: appearance of the coating film being equivalent to initial one
B: coating film formed although inferior to initial one
C: no substantial chemical conversion coating film formed

[Wettability]

In regards to the wettability of the treatment liquid for surface conditioning obtained in the Examples, the following were performed on the assumption that the treatment liquid for surface conditioning was contaminated after degreasing at 40 degrees Celsius for 1 minute using the test-piece-treated degreasing treatment liquid (mentioned above). A mixed liquid with the test-piece-treated degreasing treatment liquid (mentioned above) which was diluted to 1/100, was treated for surface conditioning at a room temperature for 30 sec, and the wettability of the test piece was evaluated with the standards as follows.

A: no repelling
B: repelling only at edge
C: repelling on entire surface

[Corrosion Resistance]

The test sheets following the chemical conversion treatment were subjected to cation electrodeposition coating with a solution for cation electrodeposition ("POWERNIX 110", trade name, manufactured by NIPPON PAINT CO., LTD.) such that the dry film thickness became 20 μm. The test sheets were produced by washing with water, and thereafter baking by heating at 170 degrees Celsius for 20 min. After making two longitudinally parallel cuts so as to reach to the base material, they were subjected to a salt dip test (5% salt water, dipping for 480 hrs at 35 degrees Celsius). Thereafter, tape stripping of the cut portions was performed, and the stripped width was evaluated.

TABLE 1

| | ZINC PHOSPHATE | | | PHENOLIC COMPOUND | |
|---|---|---|---|---|---|
| | PARTICLE DIAMETER ($D_{50}$) | PARTICLE DIAMETER ($D_{90}$) | CONCENTRATION | KIND | CONCENTRATION |
| EXAMPLE 1 | 0.50 | 0.81 | 1000 ppm | PYROGALLOL | 50 ppm |
| EXAMPLE 2 | 0.51 | 0.83 | 1000 ppm | GALLIC ACID | 50 ppm |
| EXAMPLE 3 | 0.53 | 0.81 | 1000 ppm | CATECHIN | 50 ppm |
| EXAMPLE 4 | 0.52 | 0.84 | 1000 ppm | PYROGALLOL ADDITION AFTER POURING INTO BATH | 50 ppm |

TABLE 1-continued

| | | | | | |
|---|---|---|---|---|---|
| EXAMPLE 5 | 0.51 | 0.82 | 1000 ppm | TANNIC ACID-NaOH NEUTRALIZATION | 50 ppm |
| EXAMPLE 6 | 0.52 | 0.82 | 1000 ppm | PYROGALLOL | 50 ppm |
| EXAMPLE 7 | 0.51 | 0.81 | 1000 ppm | GALLIC ACID | 50 ppm |
| EXAMPLE 8 | 0.53 | 0.81 | 1000 ppm | CATECHIN | 50 ppm |
| EXAMPLE 9 | 0.51 | 0.83 | 1000 ppm | TANNIC ACID-NaOH NEUTRALIZATION | 50 ppm |
| COMPARATIVE EXAMPLE 1 | 0.55 | 0.81 | 1000 ppm | NONE | |
| COMPARATIVE EXAMPLE 2 | 0.52 | 0.82 | 1000 ppm | NONE | |
| COMPARATIVE EXAMPLE 3 | 0.51 | 0.84 | 1000 ppm | NONE | |
| COMPARATIVE EXAMPLE 4 | 3.1 | 5.89 | 1000 ppm | PYROGALLOL | 50 ppm |
| COMPARATIVE EXAMPLE 5 | 0.52 | 0.82 | 1000 ppm | NONE | |
| COMPARATIVE EXAMPLE 6 | SURFACE CONDITIONING COMPOSITION 5N-10 (1000 ppm) | | | | |

| | STABILIZER | | ADDITIVE, ETC. | |
|---|---|---|---|---|
| | KIND | CONCENTRATION | KIND | CONCENTRATION |
| EXAMPLE 1 | POLYPHOSPHORIC ACID (SN2060) | 50 ppm | NONE | |
| EXAMPLE 2 | POLYACRYLIC ACID (SN44C) | 50 ppm | NONE | |
| EXAMPLE 3 | CMC(APP84) | 50 ppm | NONE | |
| EXAMPLE 4 | POLYPHOSPHORIC ACID (SN2060) | 50 ppm | NONE | |
| EXAMPLE 5 | POLYPHOSPHORIC ACID (SN2060) | 50 ppm | NONE | |
| EXAMPLE 6 | POLYPHOSPHORIC ACID (SN2060) | 50 ppm | NONE | |
| | SMECTITE | 50 ppm | | |
| EXAMPLE 7 | POLYACRYLIC ACID (SN44C) | 50 ppm | NONE | |
| | COLLOIDAL SILICA (ST-30) | 50 ppm | | |
| EXAMPLE 8 | CMC(APP84) | 50 ppm | NONE | |
| | ACRYLAMIDE | 50 ppm | | |
| EXAMPLE 9 | POLYPHOSPHORIC ACID (SN2060) | 50 ppm | URETHANE RESIN | 50 ppm |
| COMPARATIVE EXAMPLE 1 | POLYPHOSPHORIC ACID (SN2060) | 50 ppm | NONE | |
| COMPARATIVE EXAMPLE 2 | POLYACRYLIC ACID (SN44C) | 50 ppm | NONE | |
| COMPARATIVE EXAMPLE 3 | CMC(APP84) | 50 ppm | NONE | |
| COMPARATIVE EXAMPLE 4 | POLYPHOSPHORIC ACID (SN2060) | 50 ppm | NONE | |
| COMPARATIVE EXAMPLE 5 | POLYACRYLIC ACID (SN44C) | 50 ppm | NONE | |
| | COLLOIDAL SILICA (ST-30) | 50 ppm | | |
| COMPARATIVE EXAMPLE 6 | SURFACE CONDITIONING COMPOSITION 5N-10 (1000 ppm) | | | |

TABLE 2

| | COATING FILM APPEARANCE | | | | COATING FILM APPEARANCE (CRYSTAL) μm | | | |
|---|---|---|---|---|---|---|---|---|
| | SPC | GA | Al (ELECTROLYTIC CORROSION PART) | HIGH-TENSILE STEEL SHEET | SPC | GA | Al (ELECTROLYTIC CORROSION PART) | HIGH-TENSILE STEEL SHEET |
| EXAMPLE 1 | A | A | A | A | <1 | ABOUT 1 | 2~5 | |
| EXAMPLE 2 | A | A | A | A | <1 | ABOUT 1 | 2~5 | <1 |
| EXAMPLE 3 | A | A | A | A | <1 | ABOUT 1 | 2~5 | |
| EXAMPLE 4 | A | A | A | A | <1 | ABOUT 1 | 2~5 | <1 |
| EXAMPLE 5 | A | A | A | A | <1 | ABOUT 1 | 2~5 | |
| EXAMPLE 6 | A | A | A | A | <1 | ABOUT 1 | 2~5 | |
| EXAMPLE 7 | A | A | A | A | <1 | ABOUT 1 | 2~5 | <1 |

TABLE 2-continued

| | | | | | | | | |
|---|---|---|---|---|---|---|---|---|
| EXAMPLE 8 | A | A | A | A | <1 | ABOUT 1 | 2~5 | |
| EXAMPLE 9 | A | A | A | A | <1 | ABOUT 1 | 2~5 | |
| COMPARATIVE EXAMPLE 1 | C | C | C | C: PARTLY RUSTED | — | — | — | — |
| COMPARATIVE EXAMPLE 2 | C | C | C | C: PARTLY RUSTED | — | — | — | — |
| COMPARATIVE EXAMPLE 3 | C | C | C | C: PARTLY RUSTED | 1~2 | 2 | 5~10 | 2~5 |
| COMPARATIVE EXAMPLE 4 | C | C | C | C: PARTLY RUSTED | 1~2 | 2 | 5~10 | 2~5 |
| COMPARATIVE EXAMPLE 5 | C | C | C | C: PARTLY RUSTED | — | — | — | — |
| COMPARATIVE EXAMPLE 6 | B | B | D | D: PARTLY RUSTED | 2 | 4 | D | — |

| | AMOUNT OF ADHESION ($mg/m^2$) | | AMOUNT OF COATING FILM ($g/m^2$) | | STABILITY | WETTABILITY | CORROSION RESISTANCE |
|---|---|---|---|---|---|---|---|
| | SPC | Al | SPC | Al | SPC | SPC | SPC |
| EXAMPLE 1 | | | 1.6 | 1.5 | A | A | 0 mm |
| EXAMPLE 2 | 12 | 18 | 1.6 | 1.6 | A | A | 0 mm |
| EXAMPLE 3 | | | 1.5 | 1.6 | A | A | 0 mm |
| EXAMPLE 4 | 12 | 19 | 1.5 | 1.4 | A | A | 0 mm |
| EXAMPLE 5 | | | 1.6 | 1.5 | A | A | 0 mm |
| EXAMPLE 6 | | | 1.6 | 1.7 | A | A | 0 mm |
| EXAMPLE 7 | | | 1.5 | 1.6 | A | A | 0 mm |
| EXAMPLE 8 | | | 1.6 | 1.5 | A | A | 0 mm |
| EXAMPLE 9 | | | 1.5 | 1.6 | A | A | 0 mm |
| COMPARATIVE EXAMPLE 1 | | | 2.0 | 0.8 | B | B | 5.2 mm |
| COMPARATIVE EXAMPLE 2 | | | 1.9 | 0.7 | B | B | 5.5 mm |
| COMPARATIVE EXAMPLE 3 | 1.5 | 0.8 | 1.9 | 0.8 | B: CORRUPTED | B | 2.6 mm |
| COMPARATIVE EXAMPLE 4 | 1.2 | 1.0 | 1.9 | 0.9 | B | A | 3.2 mm |
| COMPARATIVE EXAMPLE 5 | | | 2.0 | 0.8 | B | B | 5.6 mm |
| COMPARATIVE EXAMPLE 6 | | | 1.9 | 0.1 | C | A | 0.3 mm |

In cases where the treatment liquids for surface conditioning of the Examples were used, a sufficient amount of chemical conversion coating film was formed on all of the cold-rolled steel sheets, galvanized sheets, hot rolled steel sheets, and high-tensile steel sheet, and furthermore, a sufficient amount of chemical conversion coating film was formed also on an electrolytic corrosion portion of the aluminum sheet at the part of contact with different kinds of metals, i.e. the aluminum sheet and the galvanized sheet. In other words, even though different kinds of metal materials were simultaneously subjected to the treatment liquid for surface conditioning of the Examples, it was possible to form a sufficient amount of chemical conversion coating film. In other words, even in cases where the treatment liquid for surface conditioning was used after standing for a long time after dilution, it was possible to form a sufficient amount of chemical conversion coating film.

INDUSTRIAL APPLICABILITY

The surface conditioning composition of the present invention can be suitably used for a variety of metal materials which have been employed in automotive bodies, home electric appliances, and the like.

The invention claimed is:

1. A surface conditioning composition comprising a bivalent or trivalent metal phosphate particles and having a pH of 3 to 12, wherein a $D_{50}$ of the bivalent or trivalent metal phosphate particles is no more than 3 μm, and the surface conditioning composition further comprises (1) a phenolic compound and (2) a stabilizer, wherein the (1) phenolic compound is at least one compound selected from the group consisting of flavonoid, tannin, gallic acid, lignin, catechin and pyrogallol.

2. The surface conditioning composition according to claim 1, wherein the bivalent or trivalent metal phosphate particles is zinc phosphate.

3. The surface conditioning composition according to claim 1, wherein the composition comprises 1 to 1000 ppm or the (1) phenolic compound as a treatment liquid for surface conditioning.

4. The surface conditioning composition according to claim 1, wherein the (2) stabilizer is at least one selected from the group consisting of phosphonic acid, phytic acid, polyphosphoric acid, phosphonic acid group-containing acrylic resin and vinylic resin, carboxyl group-containing acrylic resin and vinylic resin, saccharide, and the layered clay mineral.

5. The surface conditioning composition according to claim 1, wherein the composition comprises 1 to 1000 ppm of the (2) stabilizer as a treatment liquid for surface conditioning.

6. A method for surface conditioning comprising a step of bringing the surface conditioning composition according to claim 1 in contact with a metal material.

* * * * *